US007992274B2

(12) United States Patent
Hickman

(10) Patent No.: US 7,992,274 B2
(45) Date of Patent: Aug. 9, 2011

(54) METHOD OF MAKING AN OPEN-HEAD POWER TONG ASSEMBLY

(76) Inventor: Don Darrell Hickman, Williston, ND (US)

( * ) Notice: Subject to any disclaimer, the term of this patent is extended or adjusted under 35 U.S.C. 154(b) by 512 days.

(21) Appl. No.: 11/753,366

(22) Filed: May 24, 2007

(65) Prior Publication Data

US 2008/0289166 A1 Nov. 27, 2008

(51) Int. Cl.
*B25B 13/50* (2006.01)
*B23P 17/04* (2006.01)

(52) U.S. Cl. ..... 29/401.1; 29/428; 29/700; 81/57.15; 81/57.33

(58) Field of Classification Search ..... 29/401.1, 29/426.1, 428, 700; 81/57.15, 57.33
See application file for complete search history.

(56) References Cited

U.S. PATENT DOCUMENTS 4,401,000 A * 8/1983 Kinzbach ..... 81/57.2
6,058,811 A * 5/2000 Stuart ..... 81/57.15
6,327,938 B1 * 12/2001 Pietras ..... 81/57.33
6,829,967 B1 * 12/2004 Kemp ..... 81/57.15
7,069,817 B2 * 7/2006 Wesch, Jr. ..... 81/57.16

OTHER PUBLICATIONS

BJ Hughes, Power Tong Transmission Assembly, 2 pages, Admitted Prior Art.

* cited by examiner

*Primary Examiner* — Jermie E Cozart
(74) *Attorney, Agent, or Firm* — Merchant & Gould PC

(57) ABSTRACT

A method of making an open-head power tong assembly includes the steps of providing a power tong assembly that has a first case assembly and a transmission assemble. A second case assembly is provided that includes a casing having a sidewall with a plurality of supporting ribs, a base wall, and a top plate that define an interior region that is adapted to receive a pinion gear, a conversion shaft having first and second axial end portions, and an open-head tong assembly. The first case assembly is removed from the transmission assembly of the power tong assembly to expose a transmission shaft. The transmission shaft is removed to expose a transmission shaft opening. The second case is mounted to the transmission assembly such that the second axial end of the conversion shaft is engaged with the transmission shaft opening.

16 Claims, 4 Drawing Sheets

METHOD OF MAKING AN OPEN-HEAD POWER TONG ASSEMBLY

TECHNICAL FIELD

The present disclosure relates to power tongs, and more particularly, to open-head power tongs and a method of making open-head power tongs.

BACKGROUND

Power tongs are frequently used in the oil and gas industry for thread connecting and disconnecting oil field tubulars such as those commonly referred to as casing, tubing and as "sucker" rods. Power tongs include a tong assembly and a transmission assembly. The transmission assembly typically includes a hydraulic motor and an operator valve. The tong assembly typically includes either a closed-head tong or an open-head tong having a jaw which engages the tubulars. When the jaw of the tong assembly is clamped onto the tubulars, the transmission assembly causes the tong assembly to rotate in either a clockwise or counterclockwise direction to either thread or unthread the tubular.

Closed-head tongs have an opening in the center of the tong. Therefore, to use the closed-head tong, the tong must be placed over the end of the sucker rod such that the end of the sucker rod passes through the center of the tong. As a result of the closed-head tong having to be placed over the end of the sucker rod, closed head tongs are not preferred in many situations. Open-head tongs, on the other hand, have an open slot in the tong that allows the open-head tong to be placed laterally around the sucker rod.

The transmission assemblies associated with closed-head power tongs typically produce a greater torque output than the transmission assemblies associated with open-face power tongs. As a result, there are some instances when the closed-face power tong must be used due to the higher torque output of the transmission assembly.

As power tongs are sold with a tong assembly and a transmission assembly, there is a high cost associated with owning both a closed-head power tong assembly and an open-head power tong assembly.

It can be seen that a new open-head power tong assembly is needed. In addition, a new method of making an open-head power tong is needed. Such an open-head power tong should provide the mounting advantages of an open-head power tong along with the reliability, power and performance advantages of a closed-head power tong. Moreover, a method of making an open-head power tong should provide for easily assembling an open head power tong. The present disclosure addresses these as well as other problems associated with open-head power tongs.

SUMMARY

One aspect of the present disclosure relates to a method of making an open-head power tong assembly. The method includes the steps of providing a power tong assembly, which has a transmission assembly and a first case assembly including a closed-head tong assembly and a transmission shaft having a first axial end section and a second axial end section. A second case assembly is provided that includes a pinion gear having an opening, an open-head tong assembly having a chain sprocket and a tong head, which define an open portion, and a chain. The second case assembly also includes a conversion shaft having a first axial end portion and a second axial end portion oppositely disposed from the first axial end portion, with the first axial end portion and the second axial end portion being configured differently. A casing having a sidewall, a plurality of supporting ribs, a base wall, and a top plate that cooperate to define an open side portion and an interior region that is adapted to receive the conversion shaft, the pinion gear, the open-head tong assembly, and the chain are also included in the second case assembly.

The open side portion of the casing is generally aligned with the open portion of the open-head tong assembly. In the second case assembly, the conversion shaft is mounted to the casing with the first axial end portion of the conversion shaft disposed in the interior region of the casing and the second axial end portion of the conversion shaft disposed outside the casing. The opening in the pinion gear is engaged to the first axial end portion of the conversion shaft and the open-head tong assembly is mounted in the interior region of the casing such that the open-head tong assembly is coupled to the pinion gear through the chain. The method further includes the step of removing the first case assembly from the transmission assembly. The transmission shaft is removed from the transmission assembly to expose a transmission shaft opening. The second case assembly is mounted to a mounting surface on the transmission assembly, such that the second axial end portion of the conversion shaft is engaged with the transmission shaft opening in the transmission assembly.

Another aspect of the present disclosure relates to an open-head power tong kit for making an open-head power tong assembly. The kit includes a pinion gear having a square-shaped center opening, an open-head tong assembly that includes a chain sprocket and a tong head that cooperate to define an open portion in the open-head tong assembly that extends from the perimeter of the open-head tong assembly to the center region of the open-head tong assembly, and a chain. A casing is also included and has a sidewall, a plurality of supporting ribs, a base wall, and a top plate that cooperate to define an open side portion and an interior region that is adapted to receive the pinion gear, the open-head tong assembly, and the chain. The plurality of supporting ribs is rigidly affixed to the sidewall and the open side portion is generally aligned with the open portion of the open-head tong assembly. A transmission assembly having an internal spline and a mounting surface that is adapted for mounting to the casing is also included in the kit. The kit further includes a conversion shaft having a first axial end portion that has a square-shaped portion that is complementary to and adapted for engagement with the square-shaped center opening in the pinion gear and a second axial end portion that is splined and adapted for engagement with the transmission assembly.

A variety of additional inventive aspects are set forth in the description that follows. The inventive aspects can relate to individual features and to combinations of features. It is to be understood that both the forgoing general description and the following detailed description are exemplary and explanatory only and are not restrictive of the broad inventive concepts upon which the embodiments disclosed herein are based.

DETAILED DESCRIPTION

Reference is now be made in detail to the exemplary aspects of the present disclosure that are illustrated in the accompanying drawings. Wherever possible, the same reference numbers will be used throughout the drawings to refer to the same or like structure.

Figure 1:
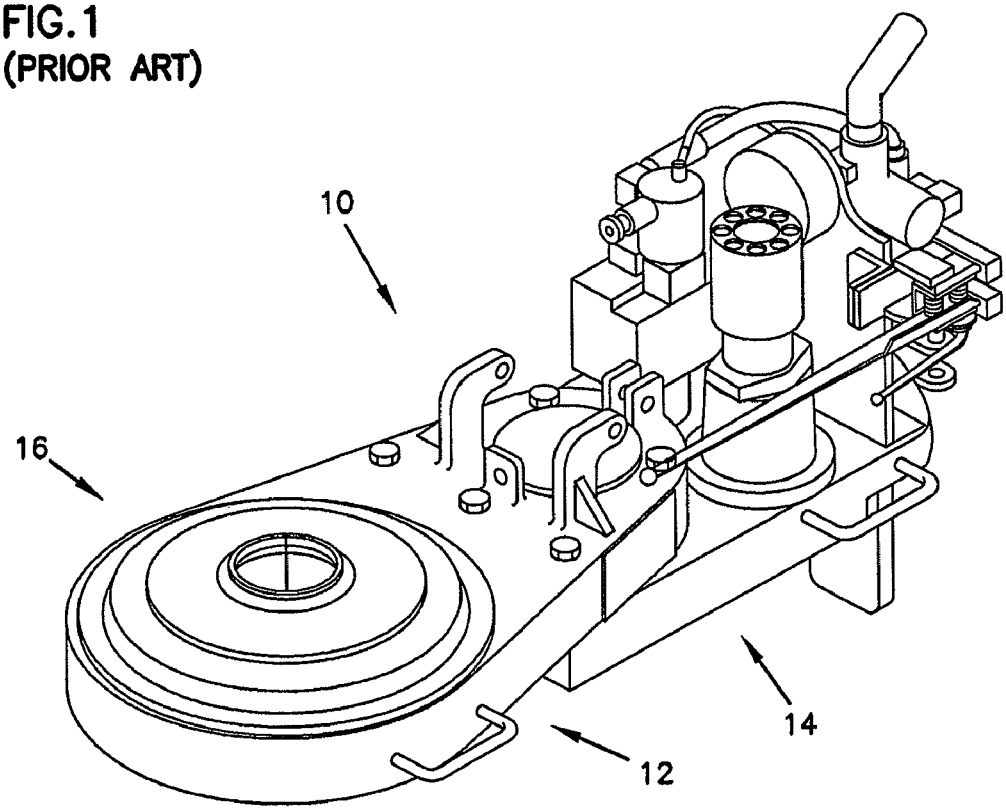
FIG. 1 (PRIOR ART)
FIG. 1 is a perspective view of a prior art closed-head power tong assembly.

Referring now to FIG. 1, a prior art power tong assembly, generally designated 10, is shown. The power tong assembly 10 includes a first case assembly, generally designated 12, and a transmission assembly, generally designated 14. The first case assembly 12 includes a closed-head tong assembly, generally designated 16.

As stated above, power tong assemblies 10 having a closed-head tong assembly 16 are not ideal for all applications. For example, the closed-head tong assembly 16 is difficult to place around a sucker rod or pipe since the closed-head tong assembly 16 must be lifted up and placed over an end of the sucker rod or pipe. However, power tong assemblies 10 having closed-head tong assemblies 16 generally provide more torque output through the transmission assembly 14 as compared to power tong assemblies with open-head tong assemblies.

Figure 2:
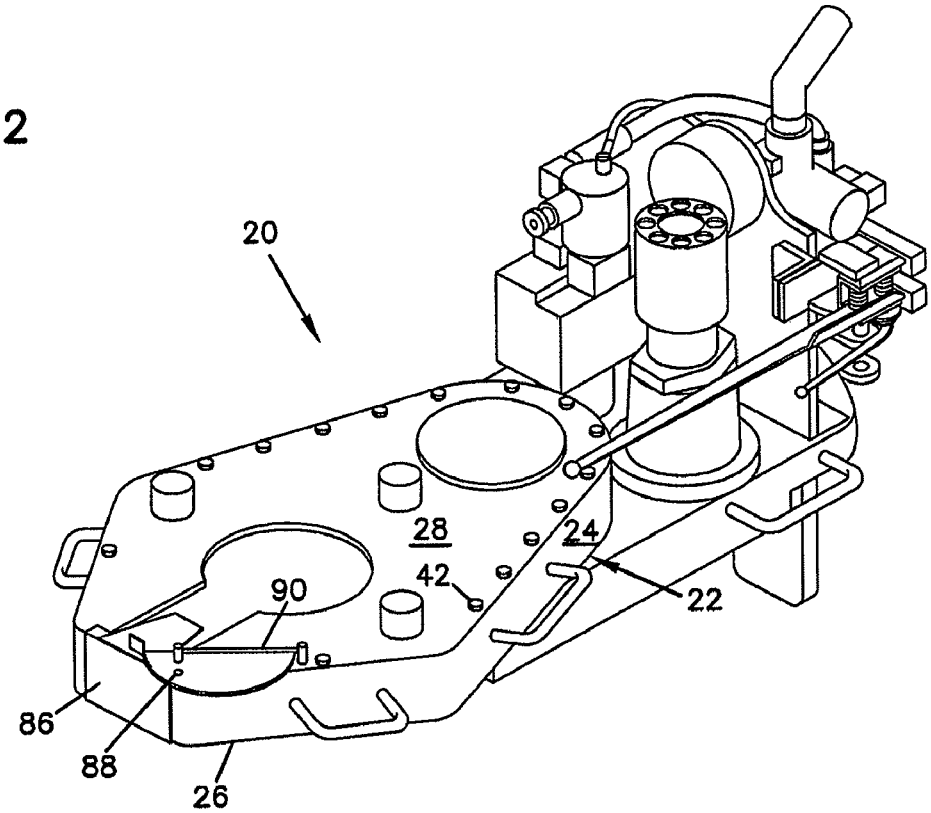
FIG. 2 is a perspective view of an open-head power tong assembly having features that are examples of inventive aspects in accordance with the principles of the present disclosure.
Figure 3:
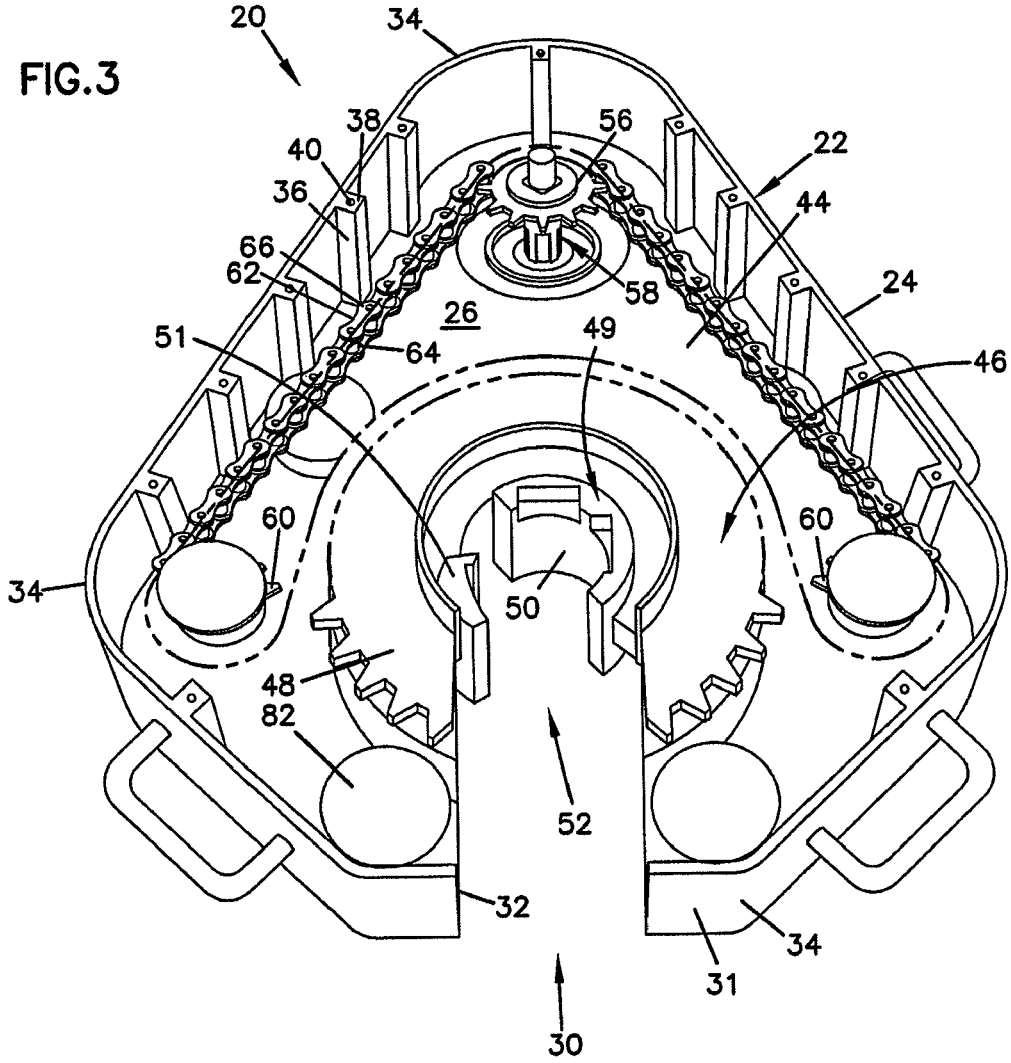
FIG. 3 is a perspective view of an interior region of an open-head tong case assembly of the open-head power tong assembly of FIG. 2.

Referring now to FIGS. 2 and 3, a second case assembly, generally designated 20, that overcomes the above stated disadvantages and limitations is described. The second case assembly 20 includes a casing, generally designated 22, having a sidewall 24, a base wall 26, and a top plate 28 mounted to the sidewall 24. The sidewall 24, base wall 26 and the top plate 28 cooperate to define an open side portion 30 (best shown in FIG. 3) disposed in an end section 31 of the second case assembly 20. The open side portion 30 is a slot in the casing 22 that has an open end 32 in the sidewall 24. The open side portion 30 extends into the end section 31 of the casing 22. In the embodiment shown, the sidewall 24, the base wall 26, and the top plate 28 are all manufactured from steel plate. While it will be appreciated that other materials such as cast steel, ductile iron, or similar materials could be used to manufacture the sidewall 24, the base wall 26 and the top plate 28, steel plate may be preferred because of its strength, the relative ease with which plate steel can be modified, and the low costs associated with initial volume production.

In the embodiment shown in FIGS. 2 and 3, a plurality of bends 34 is provided in a single piece of plate steel to form the sidewall 24. The bends 34 in the sidewall 24 allow the sidewall 24 to conform to the perimeter of the base wall 26. It will be understood by those skilled in the art, however, that the scope of the present disclosure is not limited to the sidewall 24 being manufactured from a single piece of plate steel. As best seen in FIG. 3, the sidewall 24 includes a plurality of supporting ribs 36 in fixed engagement with the sidewall 24. In the subject embodiment, the supporting ribs 36 are in welded engagement with the sidewall 24. The supporting ribs 36 provide multiple functions in the casing 22. One of those functions is a mount. An end portion 38 of each supporting rib 36 includes a threaded mounting hole 40. The top plate 28 is fastened to the sidewall 24 by fasteners 42, which are in threaded engagement with the threaded mounting holes 40 in the supporting ribs 36. Another function of the supporting ribs 36 in the casing 22 is to provide strength to the sidewall 24. The supporting ribs 36 allow the sidewall 24 to be thin, yet rigid enough to withstand high torque outputs. While the base wall 26 could also be fastened to the sidewall 24 in a similar manner, in the embodiment shown, the base wall 26 is welded to the sidewall 24.

Referring now to FIG. 3, the second case assembly 20 is shown with the top plate 28 removed. The sidewall 24 and the base wall 26 cooperate to define an interior region 44. In the embodiment shown, the interior region 44 includes an open-head tong assembly, generally designated 46. The open-head tong assembly 46 includes a chain sprocket 48 in connected engagement with a tong head, generally designated 49. The tong head 49 includes a bushing 50 and a jaw 51. The chain sprocket 48 and the tong head 49 cooperate to define an open portion 52. The open portion 52 is a slot in the open-head tong assembly 46 that extends from the periphery to the center region of the open-head tong assembly 46. The open portion 52 of the open-head tong assembly 46 is provided so as to allow a sucker rod or pipe to be moved laterally relative to the open-head tong assembly 46 for insertion and removal, eliminating the need for lifting for insertion and removal as required with closed-head tong assemblies.

In the embodiment shown, the interior region 44 further includes a pinion gear 56, which is mounted to a conversion shaft 58, a plurality of idler gear assemblies 60, each of which include a bearing and a sprocket, and a chain 62 having an inner perimeter 64 and an outer perimeter 66.

Figure 4:
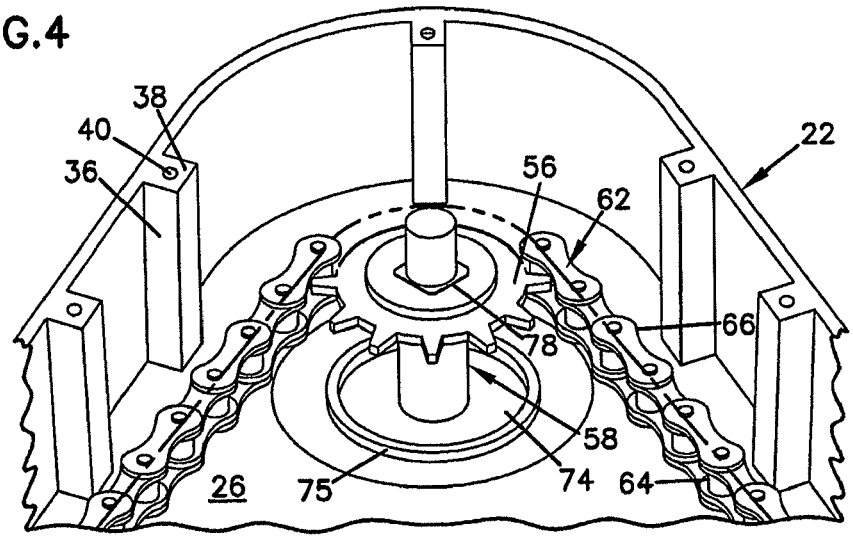
FIG. 4 is an enlarged, fragmentary perspective view of the interior region of the open-head tong case assembly of FIG. 3.
Figure 6:
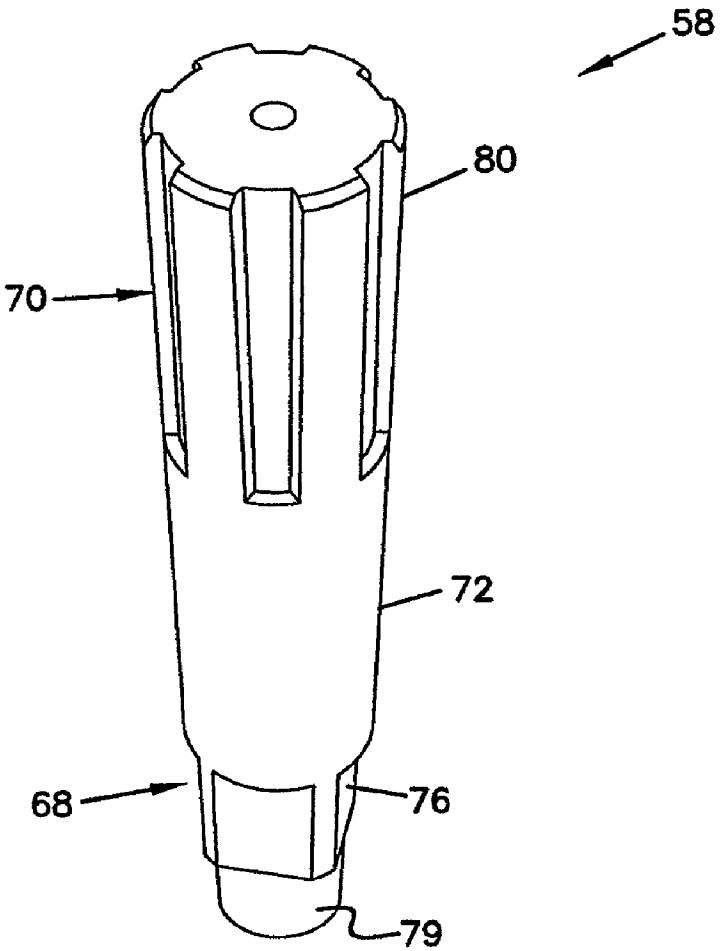
FIG. 6 is a perspective view of the conversion shaft of FIG. 5.
Figure 5:
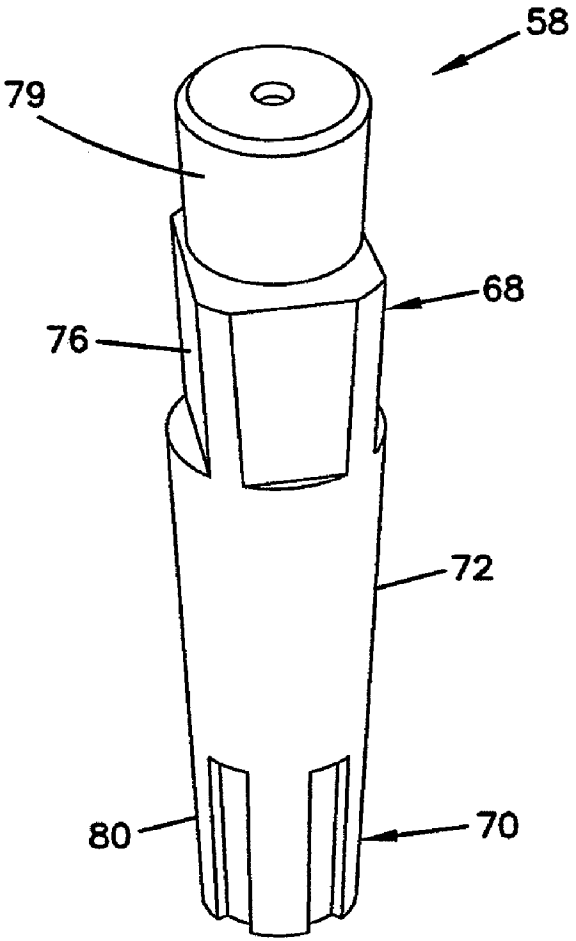
FIG. 5 is a perspective view of a conversion shaft suitable for use in the open-head tong case assembly of FIG. 3.
Figure 7:
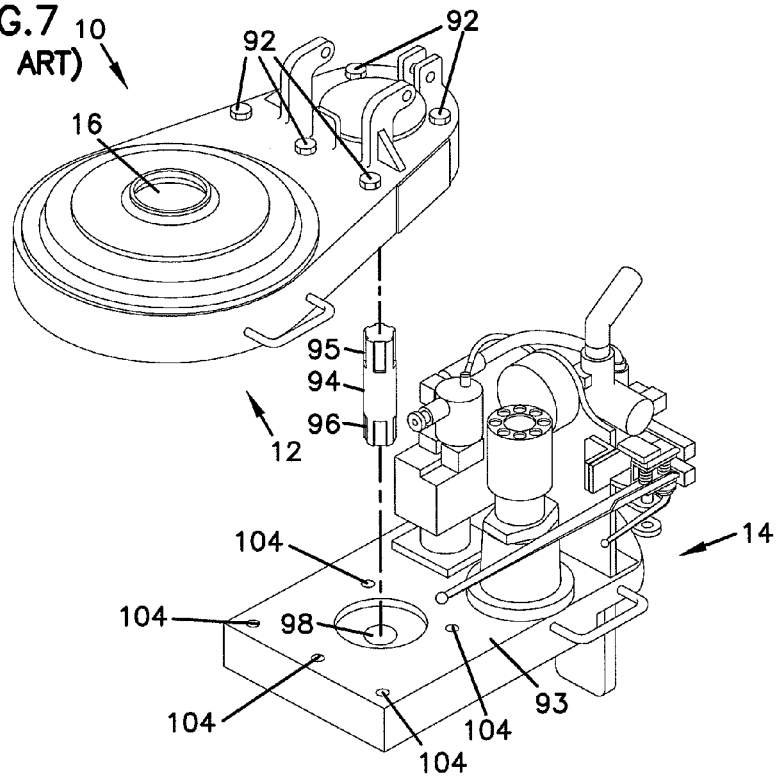
FIG.7 (PRIOR ART)
FIG. 7 is an exploded perspective view of the prior art closed-head power tong assembly of FIG. 1.
Figure 8:
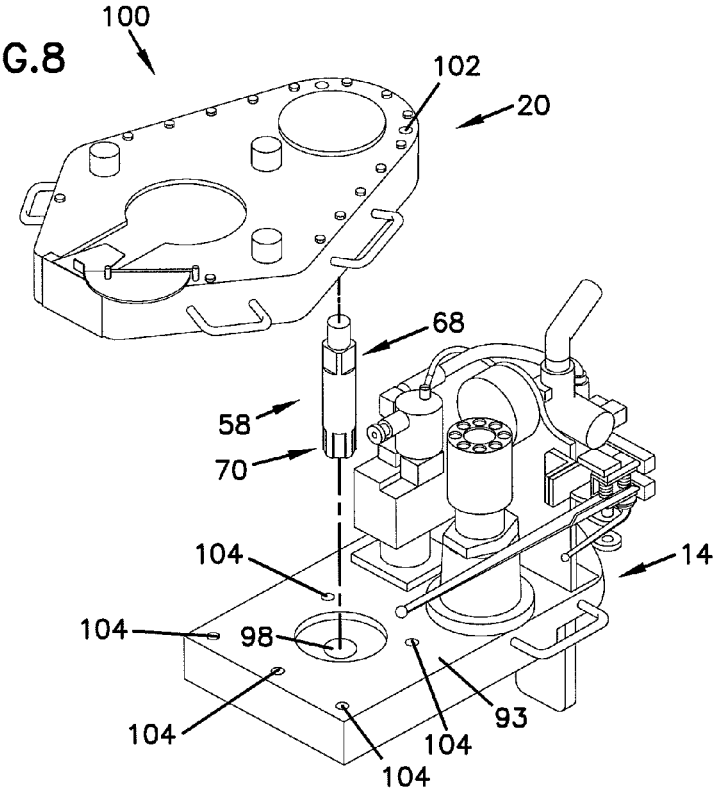
FIG. 8 is an exploded perspective view of the open-head power tong assembly of FIG. 2.

Referring now to FIGS. 4-6, the conversion shaft 58 is now described. The conversion shaft 58 includes a first axial end portion 68, a second axial end portion 70, which is oppositely disposed from the first axial end portion 68, and a sealing portion 72 disposed between the first and second axial end portions 68, 70. The sealing portion 72 of the conversion shaft 58 is rotatably mounted in a sealing element 74 such as a lip seal. The sealing element 74 is mounted in a seal mount 75 in the base wall 26 of the casing 22 such that the first axial end portion 68 is disposed in the interior region 44 of the casing 22. The second axial end portion 70, which is disposed outside of the casing 22, extends from the base wall 26. In the subject embodiment, the sealing portion 72 has a diameter that is greater than or equal to the diameter of at least one of the first axial end portion 68 or the second axial end portion 70 in order to avoid damage to the sealing element 74 during assembly.

In the embodiment shown, the first axial end portion 68 of the conversion shaft 58 includes a square-shaped portion 76. The square-shaped portion 76 is complementary to and adapted for engagement with a square-shaped center opening 78 in the pinion gear 56. The first axial end portion 68 also includes a cylindrical portion 79 disposed at the end of the first axial end portion 68 adjacent to the square-shaped portion 76. In one embodiment, the cylindrical portion 79 is adapted for engagement with a bearing assembly mounted in the top plate 28 of the casing 22 in order to provide rotational support to the conversion shaft 58. It will be understood, however, that the scope of the present disclosure is not limited to the cylindrical portion being engaged with the bearing assembly. The second axial end portion 70 includes an externally splined portion 80 for engagement with an internal spline in the transmission assembly 14. It will be understood by those skilled in the art, however, that the scope of the present disclosure is not limited to the first axial end portion 68 including the square-shaped portion 76 and the second axial end portion 70 including the externally splined portion 80 as other complementary elements may be used.

The pinion gear 56, the open-head tong assembly 46, the chain 62, the casing 22, the transmission assembly 14 and the conversion shaft 58 are contained in an open-head power tong kit. The assembly of the open-head power tong kit and a method of making an open-head power tong will now be described.

Referring again to FIGS. 2 and 3, the open-head tong assembly 46 is rotatably mounted to the base wall 26 of the casing 22 such that the open portion 52 of the open-head tong assembly 46 is generally aligned with the open side portion 30 of the casing 22. A plurality of idler rollers 82 is mounted to the base wall 26 of the casing 22. The idler rollers 82 are disposed on the base wall 26 so as to be in engagement with the outer diameter of the open-head tong assembly 46. The idler gear assemblies 60 are also mounted to the base wall 26 of the casing 22. As previously mentioned, the sealing element 74 is mounted into the seal mount 75 in the base wall 26 of the casing 22. The outer diameter of the sealing element 74 is in tight-fit engagement with the seal mount 75. The inner diameter of the sealing element 74 is in sealing engagement with the sealing portion 72 of the conversion shaft 58. The conversion shaft 58 is engaged with the sealing element 74 such that the first axial end portion 68 is disposed in the interior region 44 of the casing 22. The second axial end portion 70, however, extends from the casing 22 such that the second axial end portion 70 is disposed outside of the casing 22. With the conversion shaft 58 in sealing engagement with the sealing element 74 in the base wall 26, the pinion gear 56 can be mounted to the first axial end portion 68 of the conversion shaft 58. In the embodiment shown, the square-shaped center opening 78 of the pinion gear 56 is engaged with the square-shaped portion 76 of the first axial end portion 68 of the conversion shaft 58. The inner perimeter 64 of the chain 62 is then placed in engagement with the pinion gear 56 and the plurality of idler gear assemblies 60 while the outer perimeter 66 of the chain 62 engages the chain sprocket 48 of the open-head tong assembly 46. With these components installed inside the interior region 44 of the casing 22, the top plate 28 is then mounted to the sidewall 24 by the fasteners 42, which are in threaded engagement with the threaded mounting holes 40 in the supporting ribs 36.

With the top plate 28 mounted to the sidewall 24, a safety gate 86 is mounted to the end section 31 of the casing 22. The safety gate 86 is pivotally mounted to the casing 22. In the embodiment shown, the safety gate 86 is mounted to the casing 22 using a pin 88. The safety gate 86 pivots about the pin 88. A spring 90, which is attached to the top plate 28 and the safety gate 86, biases the safety gate 86 to a closed position (as shown in FIG. 2) so that during operation, the safety gate 86 closes the open side portion 30 of the casing 22 to prevent injury to an operator while the open-head tong assembly 46 is in use.

Referring now to FIGS. 1, 2, 7 and 8, a method of making an open-head power tong assembly 100 will now be described. As stated above, the power tong assembly 10 includes the transmission assembly 14 and the first case assembly 12 having the closed-head tong assembly 16. The first case assembly 12 is in fastened engagement with the transmission assembly 14 by a plurality of fasteners 92. To remove the first case assembly 12 of the power tong assembly 10 from the transmission assembly 14, the fasteners 92 are removed. With the fasteners 92 removed, the first case assembly 12 can be removed from the transmission assembly 14 by lifting the first case assembly 12 in a direction perpendicular to a mounting surface 93 of the transmission assembly 14. With the first case assembly 12 removed from the power tong assembly 10, a transmission shaft 94, which extends from the transmission assembly 14, is exposed. The transmission shaft 94 includes a first axial end section 95 and a second axial end section 96. The first axial end section 95 and the second axial end section 96 are splined. After the first case assembly 12 is removed, the transmission shaft 94 is also removed from the transmission assembly 14. With the transmission shaft 94 removed from the transmission assembly 14, an internally splined transmission shaft opening 98 is exposed in the transmission assembly 14.

The second case assembly 20 is positioned above the transmission assembly 14 such that the second axial end portion 70 of the conversion shaft 58 is aligned with the transmission shaft opening 98. With the second axial end portion 70 of the conversion shaft 58 aligned with the transmission shaft opening 98, the second case assembly 20 is lowered on to the transmission assembly 14 such that the second axial end portion 70 of the conversion shaft 58 engages the transmission shaft opening 98 and the base wall 26 is in contact with the mounting surface 93 of the transmission assembly 14. The second case assembly 20 is then positioned such that a plurality of mounting holes 102 in the second case assembly 20 is aligned with a plurality of corresponding holes 104 disposed in the transmission assembly 14. A plurality of fasteners is then inserted through the plurality of mounting holes 102 in the second case assembly 20 and threaded into the plurality of holes 104 in the transmission assembly 14 to securely attach the second case assembly 20 to the transmission assembly 14.

As stated above, power tong assemblies 10 with closed-head tong assemblies 16 can be difficult to place around a sucker rod or pipe since the closed-head tong assemblies 16 must be placed over an end of the sucker rod or pipe. In situations where the closed-head tong assembly 16 can not be used effectively, the above described method is advantageous since it allows for the open-head power tong assembly 100 to be made using the transmission assembly 14 of the power tong assembly 10.

In addition, the transmission assemblies 14 of the power tong assemblies 10 typically have more torque output than transmission assemblies associated with open-head power tong assemblies. The above described method is advantageous since it provides the higher torque output associated with the power tong assembly 10 to the open-head power tong assembly 100, which is easier to load, without resulting in any damage to the second case assembly 20 as the second case assembly 20 is strengthened by the plate steel casing 22 and the supporting ribs 36 affixed to the sidewall 24.

Another advantage of the above described method is that the open-head power tong assembly 100 is relatively inexpensive as compared to other power tongs. As the transmission assembly 14 from the power tong assembly 10 is used with the open-head power tong assembly 100, the cost of the open-head power tong assembly 100 is reduced since a separate transmission assembly 14 is not required. Oil and gas drillers have multiple power tong assemblies, with each of these power tong assemblies including transmission assemblies and tong assemblies. The present disclosure provides a single transmission assembly 14 to be used with multiple tong assemblies. The interchangeability of tong assemblies allow for oil and gas drillers to have multiple power tong assemblies with different configurations at a significantly reduced cost.

A further advantage of the above described method concerns maintenance. In the event that the closed-head tong assembly 16 of the power tong assembly 10 requires maintenance, the above described method allows for the first case assembly 12 having the closed-head tong assembly 16 to be removed from the transmission assembly 14 and replaced by the second case assembly 20 having an open-head tong assembly 46. This change, however, does not result in any loss of torque output since the transmission assembly 14 is the same.

Various modifications and alterations of this disclosure will become apparent to those skilled in the art without departing from the scope and spirit of this disclosure, and it should be understood that the inventive scope of this disclosure is not to be unduly limited to the illustrative embodiments set forth herein.

What is claimed is:

1. A method for making an open-head power tong comprising the steps of:

providing a power tong assembly having a transmission assembly and a first case assembly including a closed-head tong assembly and a transmission shaft;

providing a second case assembly comprising:

an open-head tong assembly, a chain, and a pinion gear defining an opening, wherein the open-head tong assembly includes a chain sprocket and a tong head that cooperate to define an open portion in the open-head tong assembly that extends from the perimeter of the open-head tong assembly to the center region of the open-head tong assembly;

a conversion shaft having a first axial end portion having a first configuration and a second axial end portion having a second configuration oppositely disposed from the first axial end portion;

a casing having a sidewall, a plurality of supporting ribs, a base wall, and a top plate that cooperate to define an open side portion and an interior region that is adapted to receive the conversion shaft, the pinion gear, the open-head tong assembly, and the chain, wherein the open side portion is generally aligned with the open portion of the open-head tong assembly;

wherein the conversion shaft is mounted to the casing with the first axial end portion of the conversion shaft disposed in the interior region of the casing and the second axial end portion of the conversion shaft disposed outside of the casing;

wherein the opening in the pinion gear is engaged to the first axial end portion of the conversion shaft;

wherein the open-head tong assembly is mounted in the interior region of the casing such that the open-head tong assembly is coupled to the pinion gear through the chain;

removing the first case assembly from the transmission assembly;

removing the transmission shaft from the transmission assembly to expose a transmission shaft opening; and aligning the second axial end portion of the conversion shaft with the transmission shaft opening in the transmission assembly;

engaging the second axial end portion of the conversion shaft with the transmission shaft opening in the transmission assembly; and mounting the second case assembly to the transmission assembly.

2. A method of making an open-head power tong as claimed in claim 1, wherein the first configuration of the first axial end portion is different than the second configuration of the second axial end portion.

3. A method of making an open-head power tong as claimed in claim 2, wherein the conversion shaft includes a sealing portion disposed between the first axial end portion and the second axial end portion.

4. A method of making an open-head power tong as claimed in claim 3, wherein the second configuration of the second axial end portion of the conversion shaft is an external spline.

5. A method of making an open-head power tong as claimed in claim 4, wherein the opening in the pinion gear is square-shaped.

6. A method of making an open-head power tong as claimed in claim 5, wherein the first configuration of the first axial end portion of the conversion shaft includes a complementary square-shaped portion for engagement with the square-shaped opening in the pinion gear.

7. A method of making an open-head power tong as claimed in claim 6, wherein the first configuration of the first axial end portion of the conversion shaft includes a cylindrical portion disposed adjacent the complementary square-shaped portion for engagement with a bearing.

8. A method of making an open-head power tong as claimed in claim 1, further comprising a safety gate mounted to the casing of the second case assembly to close the open side portion of the casing.

9. A method of making an open-head power tong as claimed in claim 8, wherein a spring biases the safety gate to a closed position that blocks the open side portion of the casing.

10. A method for making an open-head power tong comprising the steps of:

providing a power tong assembly having a transmission assembly and a first case assembly including a closed-head tong assembly and a transmission shaft;

providing a second case assembly comprising:

an open-head tong assembly, a chain, a plurality of idler gear assemblies, a plurality of idler rollers, and a pinion gear defining an opening, wherein the open-head tong assembly includes a chain sprocket and a tong head that cooperate to define an open portion in the open-head tong assembly that extends from the perimeter of the open-head tong assembly to the center region of the open-head tong assembly;

a conversion shaft having a first axial end portion and a second axial end portion, wherein the first axial end portion includes a first shaped portion complementary to the opening in the pinion gear and the second axial end portion includes a second shaped portion;

a casing having a sidewall, a plurality of supporting ribs, a base wall, and a top plate that cooperate to define an open side portion and an interior region that is adapted to receive the conversion shaft, the pinion gear, the plurality of idler rollers, the plurality of idler gear assemblies, the open-head tong assembly, and the chain, wherein the open side portion is generally aligned with the open portion of the open-head tong assembly;

a safety gate mounted to the casing, wherein the safety gate encloses the open side portion of the casing during operation;

wherein the conversion shaft is mounted to the casing with the first axial end portion of the conversion shaft disposed in the interior region of the casing and the second axial end portion of the conversion shaft disposed outside of the casing;

wherein the opening of the pinion gear is engaged to the complementary first shaped portion of the first axial end portion of the conversion shaft;

wherein the open-head tong assembly is mounted in the interior region of the casing such that the open-head tong assembly is coupled to the pinion gear through the chain;

removing the first case assembly from the transmission assembly to expose the transmission shaft;

removing the transmission shaft from the transmission assembly to expose a transmission shaft opening;

aligning the second axial end portion of the conversion shaft with the transmission shaft opening in the transmission assembly;

engaging the transmission shaft opening in the transmission assembly with the complementary second axial end portion of the conversion shaft; and mounting the second case assembly to the transmission assembly.

11. A method of making an open-head power tong as claimed in claim 10, wherein the first shaped portion of the first axial end portion of the conversion shaft is a different configuration than the second shaped portion of the second axial end portion.

12. A method of making an open-head power tong as claimed in claim 11, wherein the second shaped portion of the second axial end portion of the conversion shaft has an external spline configuration.

13. A method of making an open-head power tong as claimed in claim 12, wherein the opening in the pinion gear is square-shaped and the first shaped portion of the first axial end portion of the conversion shaft includes a complementary square-shape for engagement with the opening in the pinion gear.

14. A method of making an open-head power tong as claimed in claim 10, wherein the conversion shaft includes a sealing portion disposed between the first axial end portion and the second axial end portion.

15. A method of making an open-head power tong as claimed in claim 10, wherein the casing is manufactured from plate steel.

16. A method of making an open-head power tong as claimed in claim 10, wherein a spring biases the safety gate to a closed position that blocks the open side portion of the casing.

* * * * *